United States Patent [19]

Chen

[11] Patent Number: 4,692,112

[45] Date of Patent: Sep. 8, 1987

[54] MULTI-PURPOSE LIGHTER ASSEMBLY

[76] Inventor: Cheng-Ming Chen, No. 5-1, Te-Hui Street, Taipei, Taiwan

[21] Appl. No.: 904,863

[22] Filed: Sep. 8, 1986

[51] Int. Cl.[4] ..... F23Q 2/32

[52] U.S. Cl. ..... 431/253

[58] Field of Search ..... 431/156, 253

[56] References Cited

U.S. PATENT DOCUMENTS 2,308,225 1/1943 Edenburg ..... 431/253

4,451,229 5/1984 Nitta ..... 431/253

*Primary Examiner*—Carroll B. Dority

*Attorney, Agent, or Firm*—Browdy and Neimark

[57] ABSTRACT

The present disclosure is related to a multi-purpose lighter, more particularly, to a lighter assembly provided with a shoehorn, a writing instrument, which is compact in size for easy carrying-along, and is characterized in that a writing instrument 2 is receivably attached to the lighter embodiment 1 on the left portion and disposed next to a lighter fuel container 12 having a cylindrical shape, and counter bore 11 is positioned in the left upper part of the lighter embodiment for assembling engagement with a corresponding circular protrusion 21 at the top of the writing instrument, and a shoehorn 3 having a bottom portion 32 so configured that it can accommodate the bottom of the assembled lighter, a counter-bore 121 is also placed at the bottom of the elongate fuel container 12 for the attachment of the writing instrument for use.

1 Claim, 5 Drawing Figures

MULTI-PURPOSE LIGHTER ASSEMBLY

SUMMARY OF THE INVENTION

The present invention provides a multi-purpose lighter assembly which is particularly equipped with a writing instrument detachably received within the lighter embodiment, and a shoehorn having a bottom portion so configured that it can receive the bottom of the assembled lighter therein, and a clip element is also disposed thereon for easy attaching purpose so to prevent the lighter from being easily lost in motion.

Motivated to provide a multi-purpose lighter assembly which is not only utilized as a "match" but also be used as a writing instrument and a shoehorn, the inventor has devoted himself to this purspose and successfully come up with the practical lighter assembly.

Thus, the primary object of the present invention is to provide a lighter assembly which consists of a lighter embodiment 1, a cylinder-shaped fuel container 12 at the bottom of which is disposed a counter-bore 121 for receiving a circular protrusion 21 on the writing instrument so to attachingly assemble the same thereto for use in writing, a writing istrument 2 which is receivably attached to the left portion of the lighter embodiment which has a counter bore 11 on the left portion beside the fuel container for effecting the attachment purpose, and a shoehorn 3 having a bottom portion 32 so configured that it can receive the bottom of the assembled lighter therein in an integral manner, and a clip element 31 which can secure the assembly to a pocket or the like for easy carrying.

The secondary object of the present invention is to provide a lighter assembly equipped with a shoehorn which is available in wearing shoes at any time and place.

Detailed structure and operational modes become clear with the aid of the accompanying drawings in which:

DETAILED DESCRIPTION OF THE PREFERRED EMBODIMENT

Figure 1:
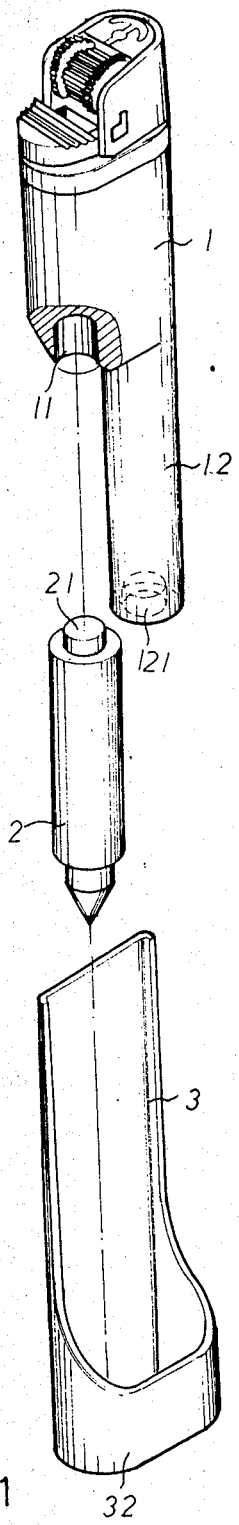
FIG. 1 is a perspective view of the exploded components of the present lighter assembly.
Figure 2:
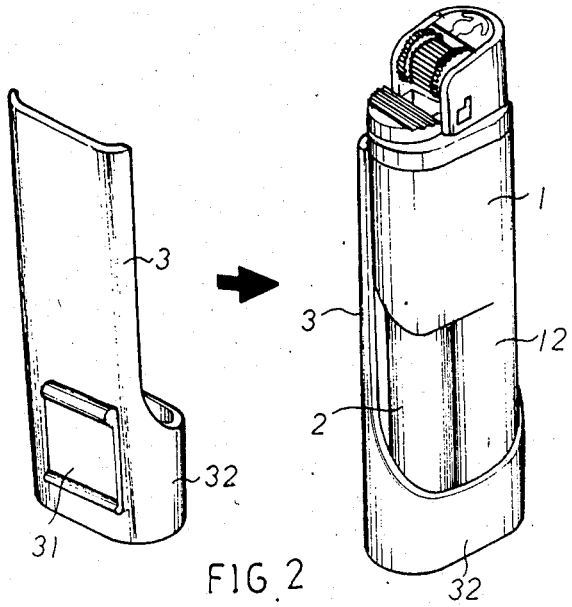
FIG. 2 is a perspective view of the assembled lighter.
Figure 3:
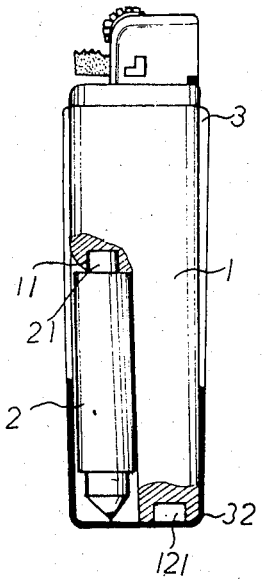
FIG. 3 is sectional view of the present lighter assembly.
Figure 4:
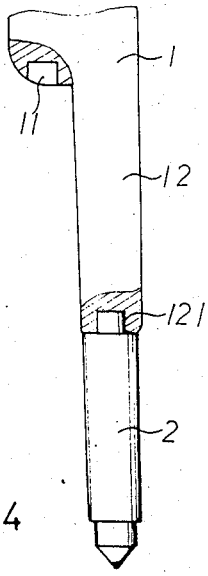
FIG. 4 is a view showing the writing instrument of the present invention in use.

Referring to FIGS. 1 and 2, the lighter assembly of the present invention consists of three portions, a lighter embodiment 1, a writing instrument 2, and a shoehorn 3, wherein the lighter embodiment 1 is made in a general shape, and an elongated cylinder fuel container 12 occupies right portion thereof and the left portion is left for the attachment of said writing instrument 2 in a side-by-side relation with said fuel container 12, a counter-bore 11 is planted on the top of said left portion so that the writing instrument 2, having a circular protrusion 21 in a corresponding shape to said counter-bore 11, can be attached to said lighter embodiment 1 in assembly, a counter-bore 121 is also placed at the bottom of said fuel container 121, in such a manner, said writing instrument 2 can be coupled thereto when used as a writing tool. Said writing instrument 2 is shaped in a cylindrical form with a circular protrusion 21 disposed at the top end thereof, the size of said writing instrument is such that it can be placed in a side-by-side relationship with said fuel container 12.

Figure 5:
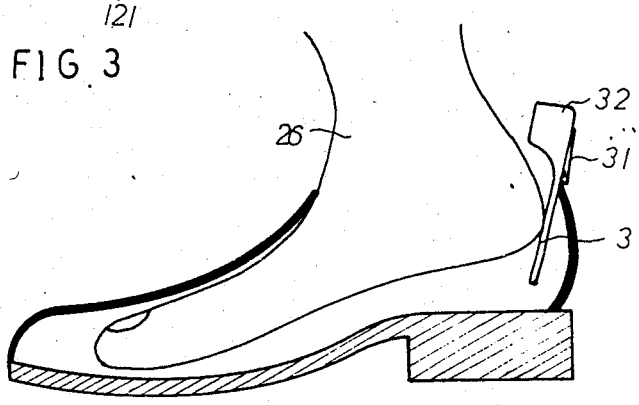
FIG. 5 is a view showing the shoehorn of the present invention being used in wearing a shoe.

Furthermore, a shoehorn 3 having a clip element 31 attached thereto, with its bottom portion 32 so configured to accommodate the bottom of said assembled lighter in order be integrated as one, is provided as shown in FIG. 1 and FIG. 2 for use in wearing shoes as shown in FIG. 5.

When not used, the writing instrument 2 can be attached to said lighter embodiment 1 side by side to said cylinder-shaped fuel container 12 with the shoehorn 3 assemblingly coupled to the bottom thereof as an integral unit as shown in FIG. 2, and the whole lighter assembly is securely clipped to a pocket or the like so that it will not be lost in motion as conventional lighters do.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

I claim:

1. A multi-purpose lighter assembly which is characterized by a lighter having a cylindrical fuel container disposed on a right portion thereof and a writing instrument detachably mounted on a left portion thereof in a side by side relationship, a circular protrusion disposed on the top of said writing instrument, a counter-bore in the left portion of the lighter and a counter-bore in the bottom of the fuel container, so that the writing instrument can be attached either to the left portion or under the said cylindrical fuel container of the lighter by engaging said circular protrusion with the respective counter-bore, and a shoehorn with a clip element and a bottom portion so shaped that it can accommodate an end of the writing instrument.

* * * * *